US008899168B1

(12) United States Patent
Fodor et al.

(10) Patent No.: US 8,899,168 B1
(45) Date of Patent: Dec. 2, 2014

(54) MOTOR BOX WITH INTEGRATED STEPS AND PLATFORM

(75) Inventors: Carrie Anne Fodor, Cape Canaveral, FL (US); Jack Stanfield Jones, Merritt Island, FL (US); John William Hamilton, Mims, FL (US)

(73) Assignee: Brunswick Corporation, Lake Forest, IL (US)

( * ) Notice: Subject to any disclaimer, the term of this patent is extended or adjusted under 35 U.S.C. 154(b) by 130 days.

(21) Appl. No.: 13/478,204

(22) Filed: May 23, 2012

(51) Int. Cl.
*B63B 17/00* (2006.01)

(52) U.S. Cl.
USPC ..... 114/361; 114/362

(58) Field of Classification Search
USPC ..... 114/361, 362, 363
IPC ..... B63B 19/00
See application file for complete search history.

(56) References Cited

U.S. PATENT DOCUMENTS 3,823,431 A * 7/1974 Miller ..... 114/361
4,928,865 A * 5/1990 Lorence et al. ..... 224/275
5,320,059 A * 6/1994 Ikeda ..... 114/363
5,497,724 A * 3/1996 Brown et al. ..... 114/343
6,681,713 B2 1/2004 Scott et al.
7,162,969 B2 1/2007 Houlder et al.
7,677,193 B2 3/2010 Roark et al.

FOREIGN PATENT DOCUMENTS

JP 56079092 6/1981

* cited by examiner

*Primary Examiner* — Stephen Avila
(74) *Attorney, Agent, or Firm* — Malin Haley DiMaggio & Bowen, P.A.

(57) ABSTRACT

The present invention provides a motor box for a sea-faring vessel, comprising a skirt, a lid, and a lid cushion. The lid is pivotably attached to the skirt and the lid cushion is pivotably attached to the lid. Accordingly, the lid opens to provide access to the inboard motor of which the motor box encases. The lid cushion pivots to reveal the top surface of the lid, which may be textured. The forward side of the skirt and the lid include a step which allows a user to step onto and over the motor box for easier ingress/egress. An aft step may be disposed adjacent to the aft of the motor box at the transom to provide additional footing when stepping off of or onto the motor box.

9 Claims, 5 Drawing Sheets

MOTOR BOX WITH INTEGRATED STEPS AND PLATFORM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to sea-faring vessels and in particular to a motor box or motor housing having integrated steps and a platform.

2. Description of Related Art

In the field of pleasurecraft and sport boats, it is common to utilize inboard motors in order to provide a relatively open transom at the stern of the vessel. Inboard motor designs often provide certain advantages compared to outboard motor designs, which typically interfere with and obstruct the transom of a boat. In a typical inboard motor configuration, the entire motor is enclosed within the hull, allowing for the full, unobstructed use of the transom for activities such as water-skiing, knee-boarding, tubing, swimming, and the like. Inboard designs also provide a certain design aesthetic, tending to appear sleeker and more streamlined as compared to outboard motor configurations. However, because the motor is disposed within the hull of the vessel in an inboard configuration, the motor block will often extend forward and upward into the cockpit of the vessel. So while inboard motors provide a relatively unobstructed transom, they obstruct the cockpit and reduce the overall useable space on the deck of the boat.

Typically, the portion of motor block of an inboard motor that extends into the cockpit is covered by a motor box. Many configurations of motor boxes exist, most of which provide some sort of removable or pivoting motor lid, which lid may often be covered with a cushion in order for the motor box to double as a seating surface. Nonetheless, because of the relatively large size of the motor, the arrangement and configuration of the motor box covering the motor block requires users to step on or climb over the motor box should they wish to enter or exit the vessel at the stern. Alternatively, boaters are resolved to climbing or stepping over jump seats or other surfaces at the rear of the boat. Stepping on or over the motor box (or jump seat) can present a substantial safety risk, particularly if it is covered with a cushion that does not otherwise provide significant footing traction. Moreover, the act of stepping over a large motor box is generally difficult, if not impossible for certain individuals. While there have been several attempts are providing improved motor box designs, none have solved the ingress/egress problem described above.

For example, U.S. Pat. No. 7,162,969 to Houlder et al. describes an aft platform unit for an inboard-powered vessel that can be lowered or raised by a powered actuator. The unit is disposed at the transom of the vessel and travels along inclined guides on opposite sides of the stern. The platform can be lowered into to the water to provide improved ingress/egress for a swimmer. Steps formed on the exterior of the hull are revealed as the platform is lowered whereby the steps are accessible through a gap in the aft gunwale. The steps lead down to the platform.

U.S. Pat. No. 6,681,713 to Scott et al. describes a combination engine compartment cover and privacy enclosure which includes a frame member that is rotatable about a pivot adjacent to an engine compartment access through a deck of a pontoon boat. The entire enclosure can rotate upward to an access position or can be used as a privacy enclosure in a closed position. A top cover is provided which is moveable/pivotable between a stowed and upright position. When the assembly is closed, a lounge seat is formed.

U.S. Pat. No. 5,497,724 to Brown et al. describes an aft seating design for vessels which includes a combination of a double bench seat, a hi/low single person seat, and partial sun pad extending transversely in the aft section of the boat. Multiple configurations are provided, including access steps formed into the single seat section which allows ingress/egress to the rear of the vessel. An upper hatch assembly is hinged across the aft end of the seating assembly and can be raised or lowered with electric actuators to gain access to the bilge and motor or engine compartment. The engine hatch assembly does not provide a suitable means for ingress/egress, such as steps or the like.

It is, therefore, to the effective resolution of the aforementioned problems and shortcomings of the prior art that the present invention is directed. However, in view of the motor boxes and motor configurations in existence at the time of the present invention, it was not obvious to those persons of ordinary skill in the pertinent art as to how the identified needs could be fulfilled in an advantageous manner.

SUMMARY OF THE INVENTION

The present invention provides a motor box for a sea-faring vessel, comprising a skirt, a lid, and a lid cushion. The lid is disposed between the skirt and the lid cushion. The lid is pivotably attached to the skirt and the lid cushion is pivotably attached to the lid. Accordingly, the lid opens to provide access to the inboard motor of which the motor box encases. The lid cushion pivots to reveal the top surface of the lid, which may be a non-skid textured surface. The forward or bow side of each of the skirt and the lid includes a step which allows a user to step onto and over the motor box for easier ingress/egress. In some embodiments, the lid cushion is pivotably attached to a port side of the lid and in some cases the lid cushion pivots about a first axis with respect to the lid and the lid pivots about a second axis with respect to the skirt, wherein the first axis is orthogonal with respect to the second axis.

The present invention also contemplates a vessel configuration including the motor box described above. Accordingly, the present invention may include a vessel having a bow and a stern, comprising a hull, a deck, a cockpit, a transom, and a motor box wherein the transom defines a platform extending at the stern of the vessel and the motor box comprises a skirt, a lid, and a lid cushion wherein the lid is disposed between the skirt and said the cushion. The lid is pivotably attached to the skirt and said lid cushion is pivotably attached to the lid. The bow side of each of the skirt and the lid includes a step and an aft step is disposed adjacent to a stern side of said motor box. The aft step may be stowable into a recess disposed on the transom. Accordingly, a user can utilize the skirt and lid steps, the surface of the lid (which is revealed by pivoting the lid cushion upward), and the aft step as a path for ingress/egress to/from the cockpit of the vessel over and about the rear of the vessel.

Accordingly, it is an object of the present invention to provide a safer and more stable means of rearward ingress/egress for a sea-faring vessel configured with an inboard motor.

It is a further object of the present invention to provide a motor box that provides a cushioned seating surface which can be pivoted to reveal a more stable surface for ingress/egress over and about the motor box.

It is a further object of the present invention to provide a more suitable means for rearward ingress/egress for a vessel without the need to climb over seats or other structures.

It is a further object of the present invention to provide a motor box that provides improved ingress/egress while still maintaining access to the motor of which the motor box encases.

In accordance with these and other objects which will become apparent hereinafter, the instant invention will now be described with particular reference to the accompanying drawings.

DETAILED DESCRIPTION

Figure 1:
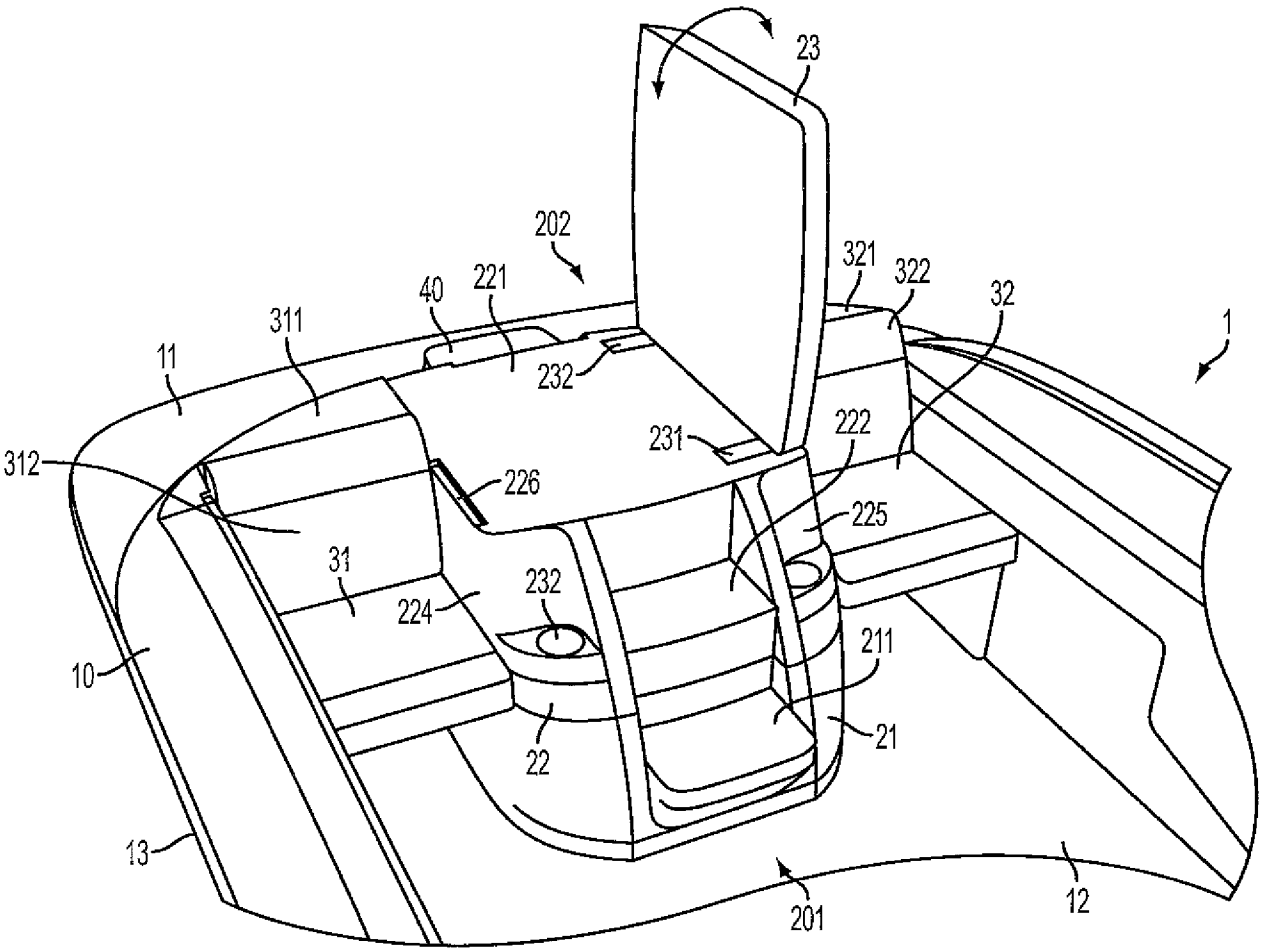
FIG. 1 is a perspective view of one embodiment of the motor box configuration of the present invention.

FIG. 1 is a front perspective view of one aspect of the present invention. Shown is an exemplary vessel 1 configured as a pleasurecraft or sport boat having an inboard motor configuration. Vessel 1 generally comprises a deck 10, a transom 11, a cockpit 12, and a hull 13. Transom 11 defines the stern wall of vessel 1 and includes a rearward extending platform. An inboard motor is disposed within hull 13, with a propeller or screw driver extending sternward from transom 11. Because of the inboard motor configuration, the motor block will extend forward and upward into cockpit 12. Accordingly, a motor box 20 is disposed within cockpit 12, and is designed to encase and cover the motor block while also providing functionality within cockpit 12.

In some embodiments, motor box 20 comprises three primary components, a skirt 21, a lid 22, and a lid cushion 23 with motor box having an forward or bow side 201 and an stern or aft side 202. In some embodiments, skirt 21 is substantially fixed to the deck 10 of vessel 1 and disposed over an opening in the deck 21 through which the motor block of the inboard motor extends. Lid 22 is situated above skirt 21 and, in some embodiments, lid 22 is pivotably attached to skirt 21. In some cases, lid 22 is pivotably attached to skirt 21 by one or more hinges disposed along the lower rear edge of lid 22 (upper rear edge of skirt 21). Lid 22 pivots upward to expose the motor block and allow service access to same. Lid cushion 23 is situated above and attached to lid 22. Accordingly, lid 22 is disposed between skirt 21 and lid cushion 23.

In some embodiments, lid cushion 23 is pivotably mounted to lid 22 in order to expose an upper planar surface 221 of lid 22. Lid cushion 23 may be mounted to lid 22 by hinges 231 and 232, which in the depicted embodiment, are disposed on the port side of motor box 20. FIG. 1 depicts lid cushion 23 in its fully opened position, substantially perpendicular to surface 221. In some embodiments, surface 221 is generally planar and may include a textured surface and/or a textured coating or layer thereon to provide footing traction for individuals stepping on surface 221. The particular hinge utilized is not limiting, as any suitable hinge or plurality of hinges may provide the desired effect, which is to allow the lid cushion 23 to be lifted in order to expose surface 221, which assists in ingress/egress over motor box 20. It is also appreciated that lid cushion 23 may be hingeably connected to any side of lid 22 however it being preferred that it hinge to the side thereof in order to expose an unobstructed walking path toward the aft of the vessel 1. Accordingly, in some embodiments, lid cushion 23 pivots about lid 22 on an axis orthogonal to the axis about which lid 22 pivots about skirt 21.

As shown in FIG. 1, in some embodiments, the bow or forward side 201 of both skirt 21 and lid 22 include a step 211 and 222, respectively. Steps 211 and 222 are defined by recesses in the each of the front portions of the skirt 21 and lid 22. Each of the steps provides a tread that is substantially parallel to the surface of deck 13 and which provides footing support for ingress/egress over and about the motor box 20.

Figure 2:
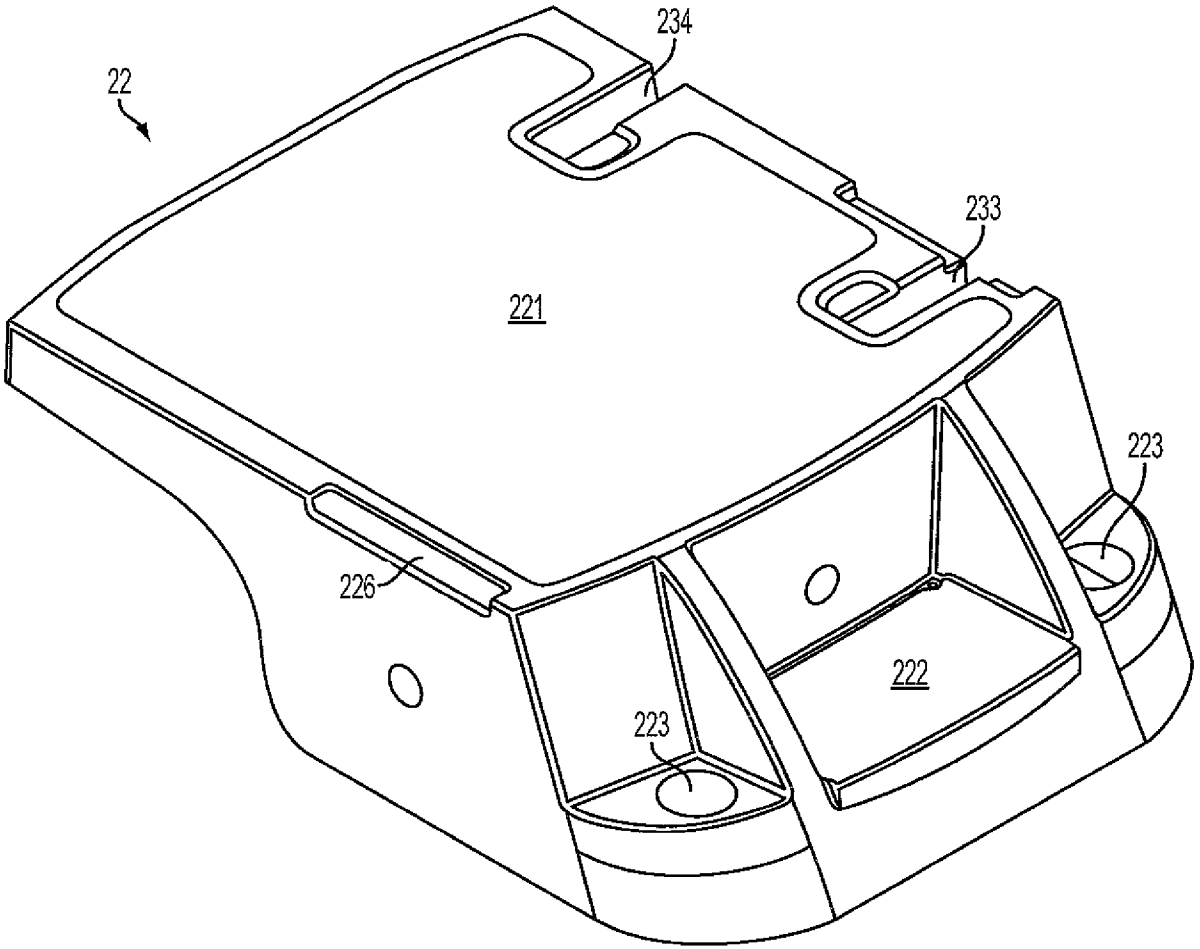
FIG. 2 is an isolated perspective view of the motor box lid of the present invention.

In some embodiments, motor box 20 is flanked on either side by seats 31 and 32 such that the respective sides 224 and 225 of lid 22 delimit inner side walls of seats 31 and 32, respectively. Lid 22 may further include one or more cup holders 223 on either side thereof which are adjacent to seats 31 and 32. Seats 31 and 32 may also include rear cushions 311 and 321 which are disposed afterward behind the backrests 312 and 322 of the seats. FIG. 2 is a isolated view of lid 22, with lid cushion 23 removed. Shown is surface 221, step 222, and cupholders 223. Also shown are recesses 233 and 234 which are configured to retain hinges 231 and 232, respectively, which comprise the pivoting connection between lid 22 and lid cushion 23. Further still, shown is recess 226 disposed on the starboard edge of lid 22 which provides room for a user's fingers in order to more easily lift and pivot lid cushion 23 about lid 22.

Figure 3:
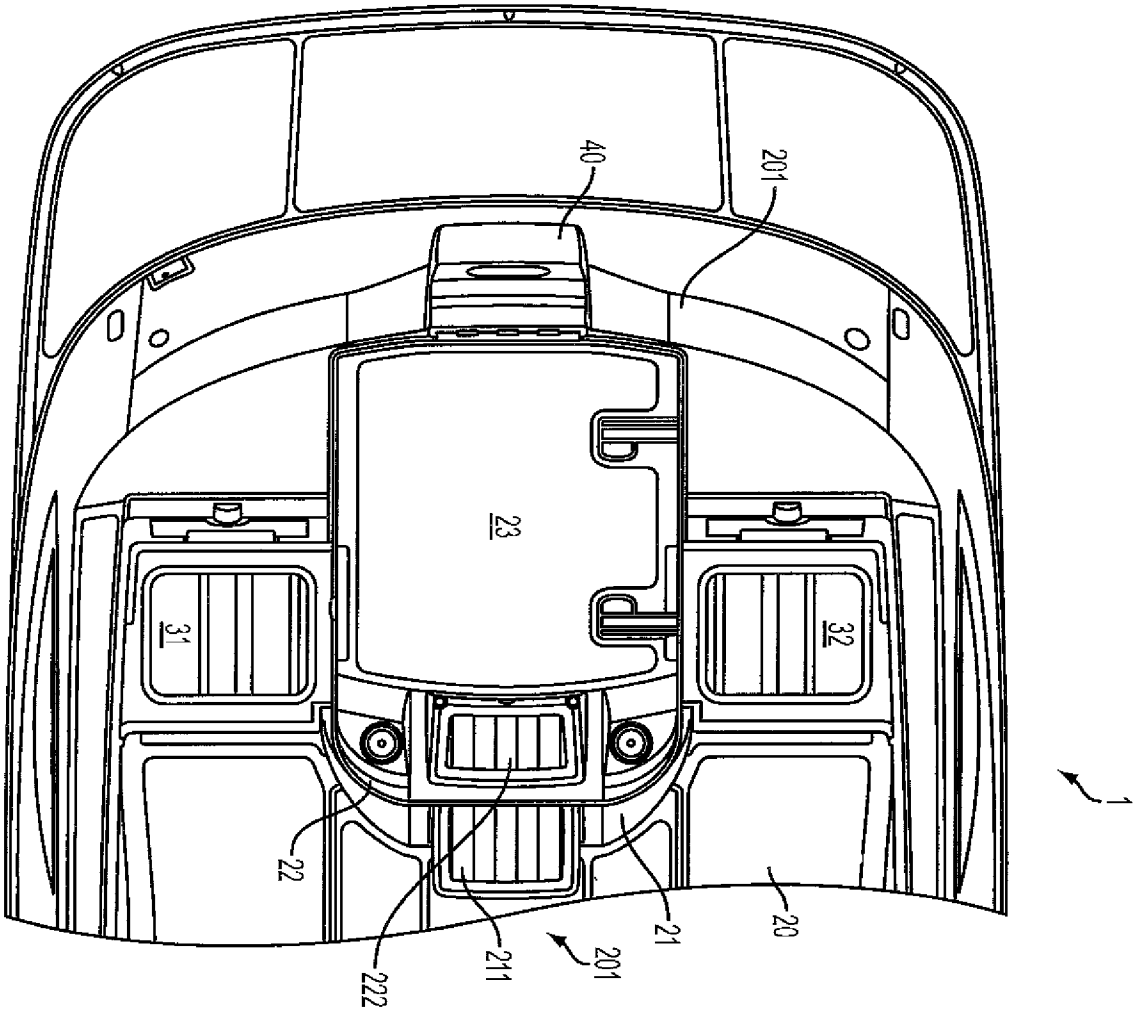
FIG. 3 is a top view of one embodiment of the motor box configuration of the present invention.
Figure 4:
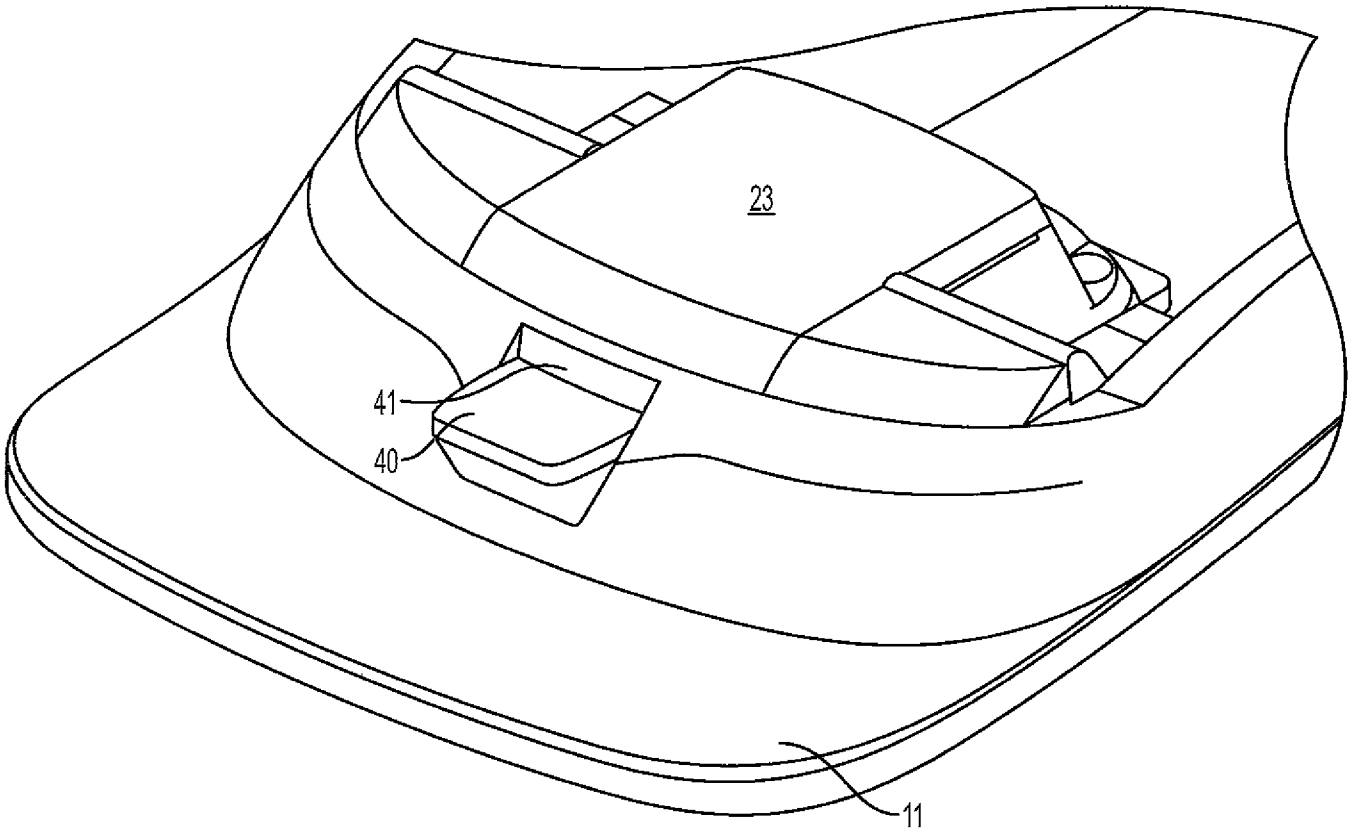
FIG. 4 is a rear perspective view of one embodiment of the motor box configuration of the present invention.

FIG. 3 is a top view of the rear section of vessel 1. Shown again is motor box 20 comprising skirt 21, lid 22, and lid cushion 23. In some embodiments, skirt 21 is generally longer than lid 22 such that step 211 extends further forward toward the cockpit than step 222. Optionally, adjacent to the stern or aft side 202 of motor box 20 and integrated into transom 11 is an aft step 40. Aft step 40 provides a footing tread which further assists ingress/egress over and about motor box 20. FIG. 4 depict aft step 40 in more detail. As shown, in some embodiments, aft step 40 is disposed at an elevation between the surface 221 of lid 22 and the rearward platform extending from transom 11. In some embodiments, aft step 40 is linear aligned with steps 211 and 222 in order to define a path over motor box 20 to the transom 11. Accordingly, aft step 40 provides additional footing and safety for ingress/egress at the transom 11. In some embodiments, aft step 40 may be retractable or foldable, for example into recess 41 on transom 11, such that it can be stowed when not in use. In a stowed position, the aft step 40 would appear integrated into the transom 11. Also shown in FIG. 4 is lid cushion 23 in its closed position, substantially parallel to and resting on surface 221 of lid 22. Accordingly, it is appreciated that lid cushion 23 is operable between at least two positions, a closed position and an open position wherein in the closed position, lid cushion 23 functions as a seat cushion for lid 22 and in the open position, exposes surface 221 for more stable ingress/egress.

Figure 5:
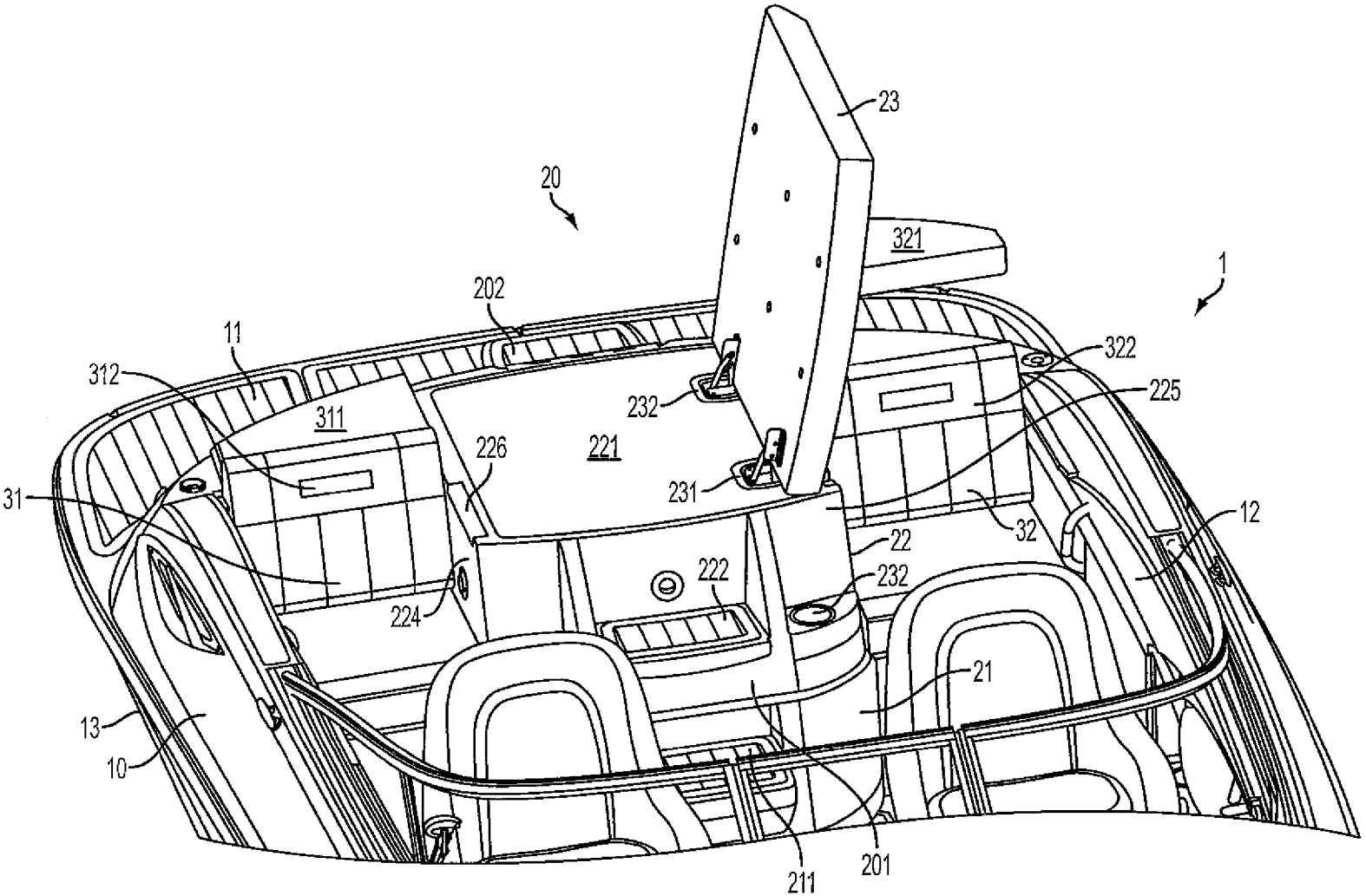
FIG. 5 is a perspective view of another embodiment of the motor box configuration of the present invention.

Based on the foregoing, it is appreciated that the present invention provides a much safer, more ergonomic, and more efficient motor box design as compared to the prior art. The present invention provides the user with a safe means of ingress/egress to and from the vessel 1 from the stern thereof. In operation, to exit the vessel cockpit 12 to the rear, a user would pivot lid cushion 23 about lid 22 to expose surface 221. Then the user can utilize steps 211 and 222, step on and over surface 221 and then down to the transom 11 of vessel 1. If aft step 40 is provided, the user can step down from surface 221, onto aft step 40, and finally onto transom 11. To enter the vessel cockpit 12 from the transom 11, the user steps onto aft step 40 (if provided), onto surface 221, and then steps down steps 222 and 211 into the cockpit 12. Lid cushion 23 can be pivoted back downward onto lid 22 as desired. It is appreciated that the provision of pivoting lid cushion 23 is advantageous because by pivoting it upward and away from lid 22, a flat and stable working surface 221 is providing. The safety and usability of surface 221 is further increased if a textured coating or surface layer is provided thereon. Further still, steps 211, 222, and 40 provide a safe and useable means for entering and exiting cockpit 12 without the need to climb or take a large step over motor box 20. FIG. 5 is a perspective view of another embodiment of the motor box configuration herein, shown with cockpit 12 including seats and other structures. This view demonstrates the usefulness of the motor box 20 with respect to ingress/egress to/from the cockpit 12 where other internal structures would otherwise be an obstruction.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A vessel having a bow and a stern, comprising;

a hull, a deck, a cockpit, a transom, and a motor box;

said transom defining a platform extending at said stern of said vessel;

said motor box comprising a skirt, a lid, and a lid cushion wherein said lid is disposed between said skirt and said lid cushion;

wherein said lid is pivotably attached to said skirt and said lid cushion is pivotably attached to said lid;

wherein a bow side of each of said skirt and said lid includes a step; and wherein an aft step is disposed adjacent to a stern side of said motor box.

2. The motor box of claim 1 wherein said lid cushion is pivotably attached to a port side of said lid.

3. The motor box of claim 1, wherein said lid cushion is pivotably attached to a starboard side of said lid.

4. The motor box of claim 1, wherein said lid further comprises one or more cup holders disposed on either side of said step of said lid.

5. The motor box of claim 1, wherein said lid delimits a planar surface.

6. The motor box of claim 5, wherein said planar surface is textured.

7. The motor box of claim 1, wherein said lid cushion pivots about a first axis with respect to said lid and said lid pivots about a second axis with respect to said skirt, wherein said first axis is orthogonal with respect to said second axis.

8. The motor box of claim 1, wherein said aft step is stowable into a recess disposed on said transom.

9. The motor box of claim 1, wherein said motor box is disposed substantially at the aft of said vessel and is adapted to encase an inboard motor.

* * * * *